US005965834A

United States Patent [19]

Suenaga et al.

[11] Patent Number: 5,965,834

[45] Date of Patent: Oct. 12, 1999

[54] ELECTRONIC CYMBAL INSTRUMENT

[75] Inventors: Yuichiro Suenaga; Minoru Harada, both of Hamamatsu, Japan

[73] Assignee: Yamaha Corporation, Japan

[21] Appl. No.: 09/009,514

[22] Filed: Jan. 20, 1998

[30] Foreign Application Priority Data

Jan. 23, 1997 [JP] Japan ..... 9-010335

[51] Int. Cl.[6] ..... G10D 13/02

[52] U.S. Cl. ..... 84/422.3; 84/723

[58] Field of Search ..... 84/422.1, 422.2, 84/422.3

[56] References Cited

U.S. PATENT DOCUMENTS 4,111,095 9/1978 Simons ..... 84/422.3

5,262,585 11/1993 Greene et al. ..... 84/645

FOREIGN PATENT DOCUMENTS 238187 2/1987 European Pat. Off. .

4-3358 2/1992 Japan .

*Primary Examiner*—Robert E. Nappi

*Assistant Examiner*—Shih-Yung Hsieh

*Attorney, Agent, or Firm*—Ostrolenk, Faber, Gerb & Soffen, LLP

[57] ABSTRACT

An electronic cymbal (10) has a first cymbal unit (12) for normal playing and a second cymbal unit (13) for cup playing which are vertically separated and attached to a common instrument holder (11). The second cymbal unit (13) of a smaller size than the first cymbal unit (12) is positioned above the first cymbal unit (12) with an intervening felt washer (22). Transducers (15, 19) are provided on the back surface of respective cymbal units (12, 13).

5 Claims, 3 Drawing Sheets

ELECTRONIC CYMBAL INSTRUMENT

BACKGROUND OF THE INVENTION

1. Field of the Invention

The present invention relates to an electronic cymbal instrument that enables normal playing as well as cup playing to be performed.

2. Description of the Related Art

Electronic cymbal sounds are generated by striking the instrument with a drumstick and converting the resulting vibrations produced in the instrument body to electrical signals and outputting the sounds through a speaker or headphone, as disclosed in a Japanese Practical Utility Model H4-3358, for example.

The performance capabilities demanded of such electronic cymbal instruments include: (1) response characteristics should be uniform regardless of the strike point; (2) vibrations generated by the strike should diminish smoothly without exhibiting the so-called "violent decay" phenomenon; (3) the impact sound generated by the drumstick should be low. For such reasons, cymbals are mostly made of a plastic plates of about 5 mm thickness molded into a flat plate or, as in non-electronic cymbal instruments, into a convex front surface. Also, to lower the impact sound, a padding made of such materials as rubber is attached to the striking region of the instrument, and, sensors such as piezo-electric elements are attached to the back surface of the cymbal to convert the mechanical vibrations to electrical signals.

To enable performing rim shot playing (normal playing) and cup playing as do non-electronic cymbal instruments, the electronic cymbals are provided with a rim section and a pad section such that normal playing sounds are produced by striking the rim section while cup sounds are produced by rapping the pad section.

FIG. 3 shows such a conventional electronic cymbal having a rubber plate 2 bonded to the central section of the instrument body 1 and a pad sensor 3, on the back surface of the instrument body 1, for converting the vibrations in the instrument body 1 to electrical signals, and a rim switch 4 to enable switching between the normal mode of playing and cup mode of playing. Also, in the case of an electronic cymbal because switching between the normal and cup modes of playing are carried out by the turning on/off the rim switch 4, it is not always necessary to match the sizes of the pad area and the rim area to those of non-electronic cymbals; also, the instrument sound range is not limited by the dimensions of the playing area.

As explained above, conventional cymbals are provided with a rim section and a pad section so as to provide the instrument with the ability to play normal and cup modes of playing. In designing the location of the strike sections, if the outer peripheral region of the instrument body is to be the pad section and the central section is to be the rim section, a cymbal player, who is accustomed to playing non-electronic cymbal instruments but is unfamiliar with electronic cymbal, experiences some difficulty in drumstick handling, because such an arrangement of the strike sections is opposite to that in non-electronic cymbal instruments.

To counter such difficulties, an arrangement may be considered so that the strike section of the instrument body on the outer peripheral section (rim section) is used for normal playing and the central section (pad section) is for cup playing. However, in either of the strike section arrangements discussed above, the strike sections are located adjacent to each other at the same level, resulting in it being quite easy to hit both sections of the instrument at the same time, because, when the player is trying to hit the central section of the instrument with the tip of the drumstick, the midpoint of the drumstick can accidentally come into contact with the edge section of the instrument. Therefore, the conventional electronic cymbal instruments presented a problem of instrument playability.

SUMMARY OF THE INVENTION

It is an object of the present invention to provide an electronic cymbal instrument to overcome the problem in playability of the conventional electronic cymbal instruments so that normal cymbal playing as well as cup playing can be performed readily by providing two cymbal units thereby improving drumstick handling and enhancing the feel and the playability of the instrument.

The object has been achieved in an electronic cymbal instrument comprising: an instrument holder, a first cymbal unit; a second cymbal unit disposed above the first cymbal unit; and a transducer, for converting vibrations into electrical signals, provided for each of the first cymbal unit and the second cymbal unit; wherein a distance between a strike section in the second cymbal unit and the instrument holder is selected to be not more than a distance between a strike section in the first cymbal unit and the instrument holder.

In the second cymbal unit, a tube section may be provided to protrude downward, such that the tube section is disposed on top of the first cymbal unit with an intervening cushioning member.

In the above instrument, the tube section has an opening facing upward for encasing within attachment parts needed to firmly attach the first cymbal unit and the second cymbal unit to the instrument holder.

According to the electronic cymbal instrument of the present invention, the first and second cymbal units are both attached to the common instrument holder in such a way that they are separated in the vertical as well in the horizontal directions. Also, the strike section in the second cymbal unit is positioned closer to the holder than that in the first cymbal unit so as not to interfere with the playing of the first unit. By providing a tube section in the second unit, a thinner cushioning material can be used to separate the first unit from the second unit. Also, because the tube section is shaped as a container to house the attachment parts for attaching the first and second units to the instrument holder, the amount of protrusion of the attachment parts is reduced to produce a neat appearance.

DESCRIPTION OF THE PREFERRED EMBODIMENT

Figure 1:
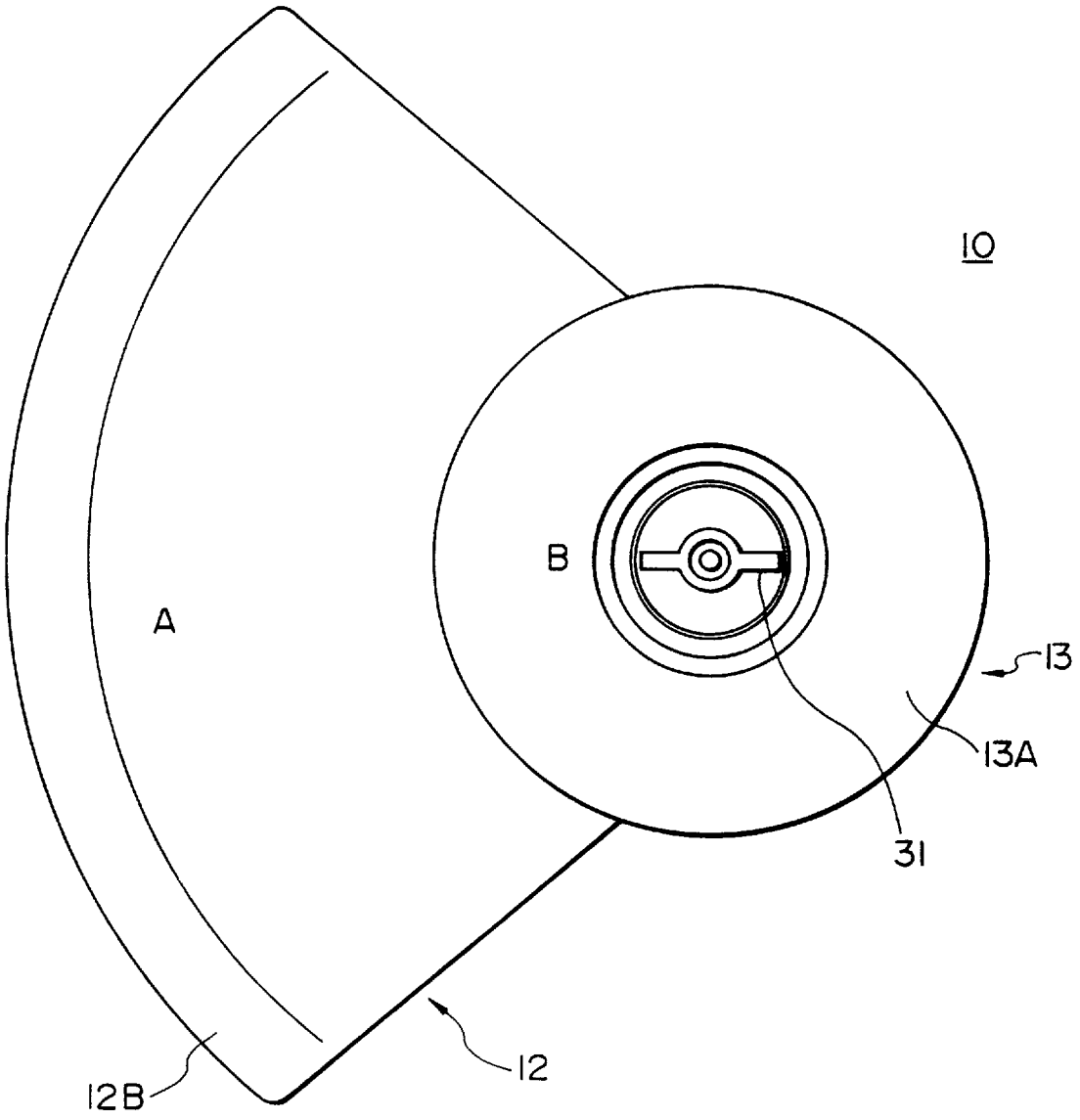
FIG. 1 is a plan view of an embodiment of the electronic cymbal instrument of the present invention.

A preferred embodiment will be presented with reference to the drawings. An electronic cymbal instrument 10 is comprised by a first cymbal unit 12 and a second cymbal unit 13, which are separated vertically and are attached to a common cymbal holder 11.

The first cymbal unit 12 is made of a material such as polymeric resin and is used for normal playing. It is comprised by a fan-shaped instrument body 12A, formed into a curved body of a gently protruding upward shape, and a rubber padding 12B, constituting the strike section, bonded to the outer peripheral edge of the front surface of the instrument body 12A. Also, a sensor 15 is firmly attached to a back surface of the instrument body 12A near the peripheral edge. The instrument body 12A is held on the cymbal holder 11 through an insertion hole 16, having a key hole 17 to prevent its rotation, provided on the pivotal corner of the fan-shaped instrument body 12A. Also, a rubber washer 18 is provided on the back surface of the insertion hole 16 at the pivotal corner.

The second cymbal unit 13 is made of such material as rubber formed roughly into a domed shape and is used for cup playing. It is comprised by an instrument body 13A having a strike section B at its outer peripheral section, and a reinforcing plate 13B provided on the outer peripheral section of the back surface. A sensor 19 is provided on the back surface of the reinforcing plate 13B. The second cymbal unit 13 is smaller than the first cymbal unit 12 and is placed above the first cymbal unit 12. Therefore, the distance D1 between the strike section B to the cymbal holder 11 in the second cymbal unit 13 is shorter than the distance D2 between the strike section A and the cymbal holder 11 in the first cymbal unit 12. Also, a tube section 20 protruding downward is provided integrally with the center region of the instrument body 13A, and the lower surface of the tube section 20 is placed on top of the first cymbal unit 12 through a felt washer (cushioning member) 22. The cymbal holder 11 is inserted through the insertion hole 23 provided in the center of the tube section 20.

The cymbal holder 11 comprises a holder body 25 for attaching to a musical score stand and bass drum during the performance. The top section of the holder body 25 includes a rotation prevention jig 26, jig seat 27, a pair of top and bottom felt washers 23, 28 for the first cymbal unit 12 sitting above the jig seat 27, and a felt washer 30 for cushioning the second cymbal unit 13 in association with the felt washer 28, and a wing nut 31.

The rotation prevention jig 26 is firmly fixed on the holder body 25 with a bolt 32, and its top end is inserted into a rotation prevention hole 17 in the first cymbal unit 12. The wing nut 31 is coupled to the top end of the holder body 25 to compress on the felt washer 30 towards the second cymbal unit 13 so as to retain the first and second cymbal units 12, 13 in place on the holder body 25. The felt washer 30 and wing nut 31 are designed to fit within a depression section 35 of the tube section 20 formed in the front center region of the instrument body 13A.

The electronic cymbal instrument 10 having the construction described above is played by hitting the strike section A of the first cymbal unit 12 with a drumstick to perform normal playing and by hitting the strike section B of the second cymbal unit 13 with a drumstick to perform cup playing. In playing such a cymbal instrument, the first cymbal unit 12 is different in size than the second cymbal unit 13, and the strike sections of the cymbal units 12, 13 are vertically separated. Therefore, it is clear that the second cymbal unit 13 does not interfere with playing of the first cymbal unit 12. It is also clear that, when the strike section B of the second cymbal unit 13 is hit to perform cup playing, there is no danger of the drumstick hitting the strike section A of the first cymbal unit 12. Furthermore, from the perspective of the player, the strike section B of the second cymbal unit 13 is positioned at the opposite end of the first cymbal unit 12 so that the second cymbal unit 13 can be played, with a sense of familiarity, as though performing cup playing on a non-electronic cymbal instrument. It follows that the present cymbal instrument enables excellent drumstick handling and instrument playability to realize maximum performance potential of the instrument.

Furthermore, because of the presence of the tube section 20 in the central region of the second cymbal unit 13, the separation distance between the first and second cymbal units 12, 13 can be made large. Additionally, the outward appearance of the cymbal instrument is neat, because the depression section 35 of the tube section 20 can hide the various attachment parts necessary to attach the first and second cymbal units 12, 13 to the cymbal holder 11 are hidden, so that little of the wing nut 31 extends beyond the top end of the second cymbal unit 13. Also, because the two cymbal units 12, 13 are attached to one common cymbal holder 11, the number of holders required is minimized.

Figure 2:
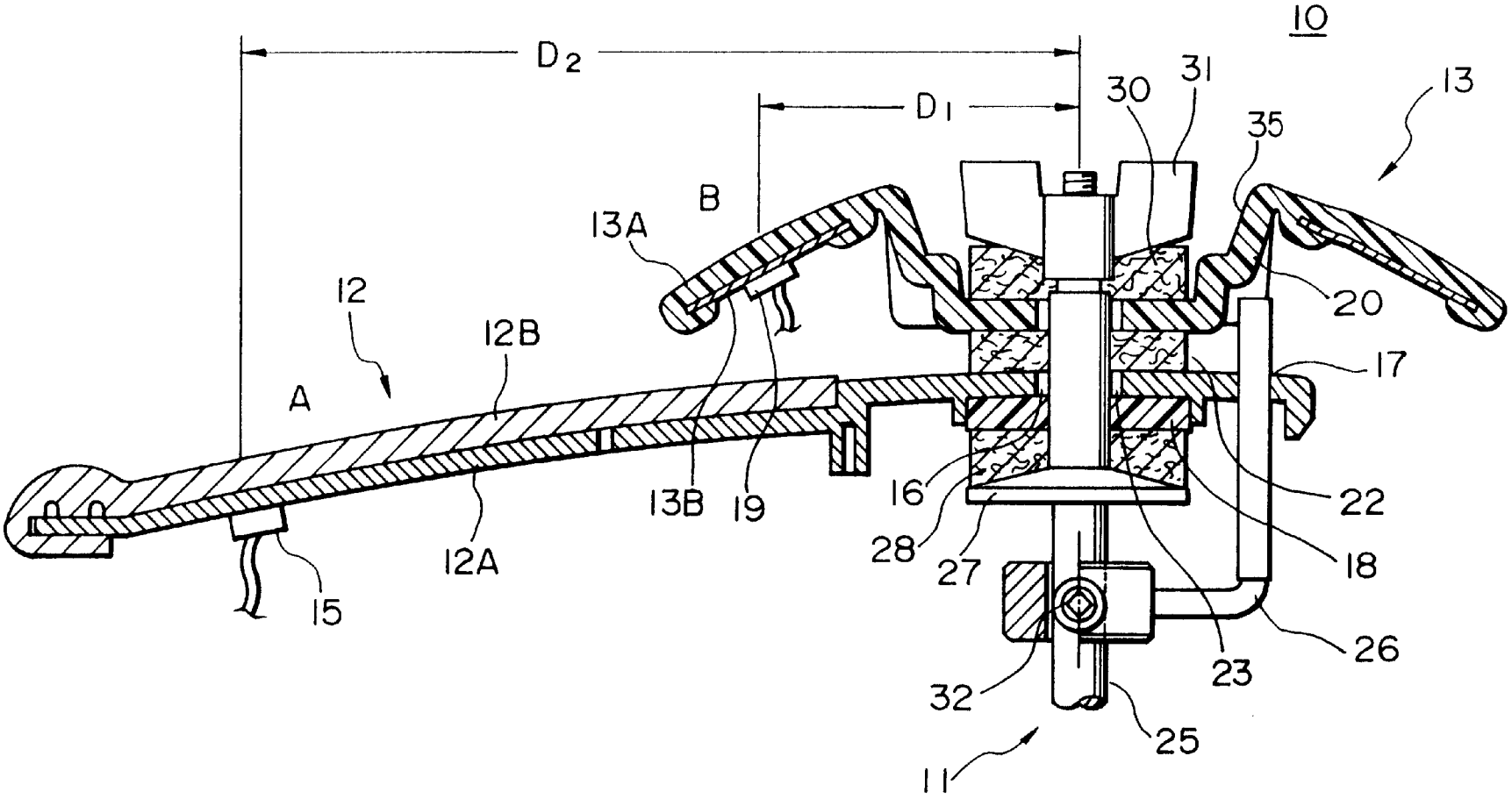
FIG. 2 is a cross sectional view of the instrument shown in FIG. 2.
Figure 3:
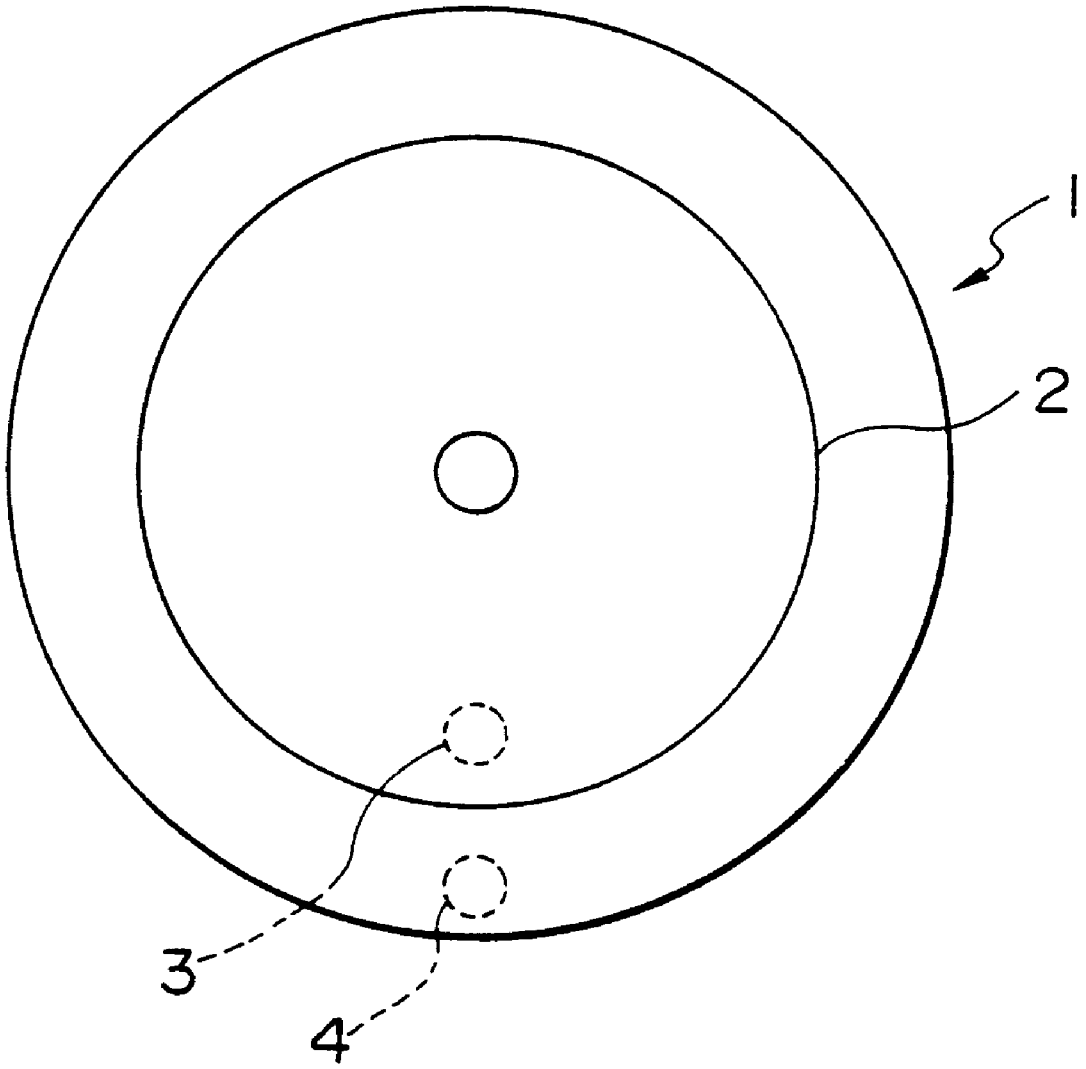
FIG.3 PRIOR ART
FIG. 3 is a plan view of a conventional electronic cymbal

In the above embodiment, the second cymbal unit 13 has been made into a dome shape, however, it is not necessary to restrict to such a shape. The shape of the second cymbal unit 12 can be made into a fan shape, as in the case of the first cymbal unit 12 shown in FIG. 2. However, it should be mentioned that the dome shape helps to realize a feel of playing traditional cup playing in an electronic cymbal instrument.

It should also be mentioned that the construction of the instrument holder 11 is not restricted to the one shown in the embodiment, and other designs are equally applicable. The essential design point is that the first cymbal unit 12 should be positioned so as to be vertically separated from the second cymbal unit 13.

What is claimed is:

1. An electric cymbal instrument comprising: an instrument holder; a non-circular shaped first cymbal unit; a rotation prevention jig for preventing the rotation of said first cymbal unit around said instrument holder; a second cymbal unit disposed above said first cymbal unit; and a transducer for converting vibrations into electrical signals, provided for each of said first cymbal unit and said second cymbal unit; wherein a distance between a point in a strike section in said second cymbal unit and said instrument holder is selected to be not more than a distance between a point in a strike section in said first cymbal unit and said instrument holder.

2. An electric cymbal instrument according to claim 1, wherein said non-circular shaped first cymbal unit has a fan-shape.

3. An electric cymbal instrument according to claim 1, wherein said rotation prevention jig is fixed said instrument holder, and the top end of said rotation prevention jig is inserted into a rotation prevention hole in said first cymbal unit.

4. An electric cymbal instrument comprising: an instrument holder; a first cymbal unit; a second cymbal unit disposed above said first cymbal unit; and a transducer for converting vibrations into electrical signals, provided for each of said first cymbal unit and said second cymbal unit; wherein a distance between a point in a strike section in said second cymbal unit and said instrument holder is selected to be not more than a distance between a point in a strike section in said first cymbal unit and said instrument holder; and a tube section protruding downward is provided in said second cymbal unit, and said tube section is disposed on top of said first cymbal unit with an intervening cushioning member.

5. An electronic cymbal instrument according to claim 4, wherein said tube section has an opening facing upward for encasing within attachment parts needed to firmly attach said first cymbal unit and said second cymbal unit to said instrument holder.

* * * * *